US005738580A

United States Patent [19]

Baek

[11] Patent Number: 5,738,580

[45] Date of Patent: Apr. 14, 1998

[54] AIR BLOWING DIRECTION ADJUSTING APPARATUS FOR AN AIR CONDITIONER

[75] Inventor: Chul-Ho Baek, Suwon, Rep. of Korea

[73] Assignee: Samsung Electronics Co., Ltd., Suwon, Rep. of Korea

[21] Appl. No.: 800,559

[22] Filed: Feb. 18, 1997

[30] Foreign Application Priority Data

| | | | |
|---|---|---|---|
| Mar. 21, 1996 | [KR] | Rep. of Korea | U 96-5546 |
| Mar. 21, 1996 | [KR] | Rep. of Korea | P 96-7776 |
| Dec. 3, 1996 | [KR] | Rep. of Korea | P 96-61290 |

[51] Int. Cl.[6] ..... F24F 7/00

[52] U.S. Cl. ..... 454/285; 454/153; 454/155

[58] Field of Search ..... 454/153, 285, 454/155, 313, 315, 319, 320, 321

[56] References Cited

U.S. PATENT DOCUMENTS

| | | | |
|---|---|---|---|
| 3,257,931 | 6/1966 | Lupton | 454/285 |
| 5,129,859 | 7/1992 | Yagi | 454/155 |
| 5,176,568 | 1/1993 | Nagatomo et al. | 454/285 |
| 5,186,387 | 2/1993 | Doi et al. | 236/49.3 |
| 5,364,303 | 11/1994 | Terry | 454/315 |

*Primary Examiner*—Harold Joyce
*Assistant Examiner*—Derek S. Boles
*Attorney, Agent, or Firm*—Burns, Doane, Swecker & Mathis, L.L.P.

[57] ABSTRACT

An air blowing direction adjusting apparatus for an air conditioner is provided in which for various discharging directions of the air and a guaranteed transmission of driving force for an accurate phase control is accomplished. There is provided an air blowing direction adjusting apparatus for an air conditioner having a discharge outlet, and a plurality of blades installed in the discharge outlet for changing the discharging direction of the air, the apparatus comprising guide pins installed in a first cam and a second cam, respectively, wherein each cam receives driving force generated from single driving unit to be driven, and first and second groups of blades divided into two groups for changing rotational positions of the blades independently for said each group or simultaneously for said two groups, in response to the actions of the guide pins.

5 Claims, 6 Drawing Sheets

AIR BLOWING DIRECTION ADJUSTING APPARATUS FOR AN AIR CONDITIONER

BACKGROUND OF THE INVENTION

1. Field of the Invention

The present invention relates to an air conditioner and, more particularly to an air blowing direction adjusting apparatus for an air conditioner including blades operated by recessed cams and guide pins.

2. Description of the Prior Art

As shown in FIG. 1, a conventional air conditioner has a front panel 3 provided at a central front surface of a main body 1 having a rear wall and two side walls thereof, operation manipulating means 5 arranged at a lower portion of the front panel 3 for establishing desired operation conditions for the air conditioner, a suction inlet 7 provided below the front panel 3 for taking in a room air into the body 1, and a discharge outlet 9 provided over the front panel 3 for discharging indoors a heat-exchanged air.

The suction inlet 7 is provided with a suction grille member 11, which is usually designed to give a good appearance thereto, for supporting a filtering member(not shown). Air blow blades 13 and 15(see FIG. 2 to 3) are provided in the discharge outlet 9 for respectively defining horizontal and vertical directions in blowing the heat-exchanged air to be discharged indoors through the discharge outlet 9, wherein the above blow blades 13 and 15 constitute a group of blades 25 and blades are spaced a constant distance from each other.

And, the discharge outlet 9 has at one side thereof air blowing direction adjusting apparatus which directs air blowing directions with the changed displacements of the respective blades 13 and 15.

The conventional air blowing direction adjusting apparatus is illustrated in FIGS. 2 and 3. In drawings, a plurality of blades 25 arranged between supporting plates 21, 23 have their ends pivotally coupled to those plates 21, 23 to which connecting rod 27 is coupled at one side thereof for commonly operating the blades 25.

The connecting rod 27 has side surface thereof with which a circular cam 29 is brought into contact. The side surface of the connecting rod 27 as an operating surface maintains the contact with an operating surface of the cam 29 by means of an elasticity means 33 opearably connecting the supporting plate 23 to the connecting rod 27.

For such a constructed air blowing direction adjusting apparatus for the conventional air conditioner, at the time of the supply of an electric power to driving means 31, the rotational force is generated from the driving means 31, which allows the cam 29 contacting the connecting rod 27 by means of the elasticity means 33 to rotate, followed by the linear motion of the connecting rod 27 by the cam 29.

Thus, the blades 25 coupled to the connecting rod 27 can be rotated with a given one direction, and when the rotational operation of the blades 25 ceases to maintain a defined position, the driving means 31 responsive to the control means stops.

However, the above-mentioned conventional air conditioner has a problem in that the discharging direction of the heat-exchanged air has only single direction in carrying a uniform amount of the air through the discharge outlet 9, because a plurality of blades 25 can be arranged only in a certain direction by single connecting rod 27, for example, as in FIGS. 4A to 4C, each of which shows a longitudinal direction taken in a sectional view of each blade 25, and exhibits only one direction, although the displacement of the blades is adjusted.

Moreover, the cam 29 is designed to be brought into contact with the operating surface of the connecting rod 27 dependent upon the resilient force stored in the spring, but the transmission of the driving force cannot be guaranteed which causes the inaccurate control in phase.

SUMMARY OF THE INVENTION

Therefore, it is an object of the present invention to provide an air blowing direction adjusting apparatus for an air conditioner in which various discharging directions of the air and a guaranteed transmission of driving force for an accurate phase control can be accomplished.

The above objects are accomplished by an air blowing direction adjusting apparatus for an air conditioner having a discharge outlet, and a plurality of blades installed in the discharge outlet for changing the discharging direction of the air, the apparatus comprising:

guide pins installed in a first cam and a second cam, respectively, wherein each cam receives driving force generated from single driving means to be driven; and first and second groups of blades divided into two groups for changing rotational positions of the blades independently for said each group or simultaneously for said two groups, in response to the actions of the guide pins.

Further, this invention provides an air blowing direction adjusting apparatus for an air conditioner having a discharge outlet, and a plurality of blades installed in the discharge outlet for changing the discharging direction of the air, the apparatus comprising:

first and second cams installed to single driving means;

guide balls installed in each one of first and second cams; and first and second groups of blades divided into two groups for changing rotational positions of the blades independently for said each group or simultaneously for said two groups, in response to the actions of the guide pins.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT

The preferred embodiment according to the present invention will now be described in detail with reference to FIGS. 5 to 7.

Embodiment 1

Figure 1:
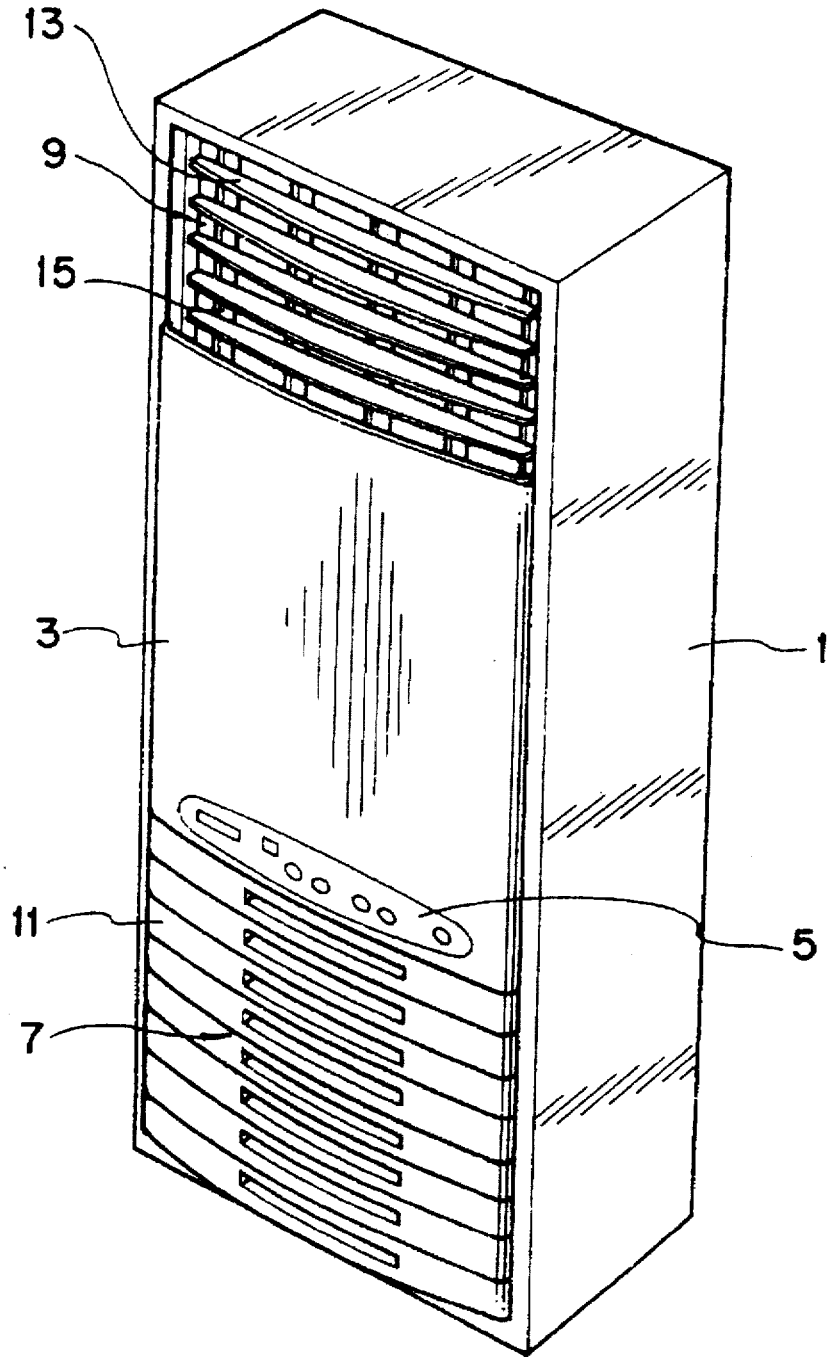
FIG. 1 (PRIOR ART)
FIG. 1 is a perspective view of a conventional air conditioner.
Figure 2:
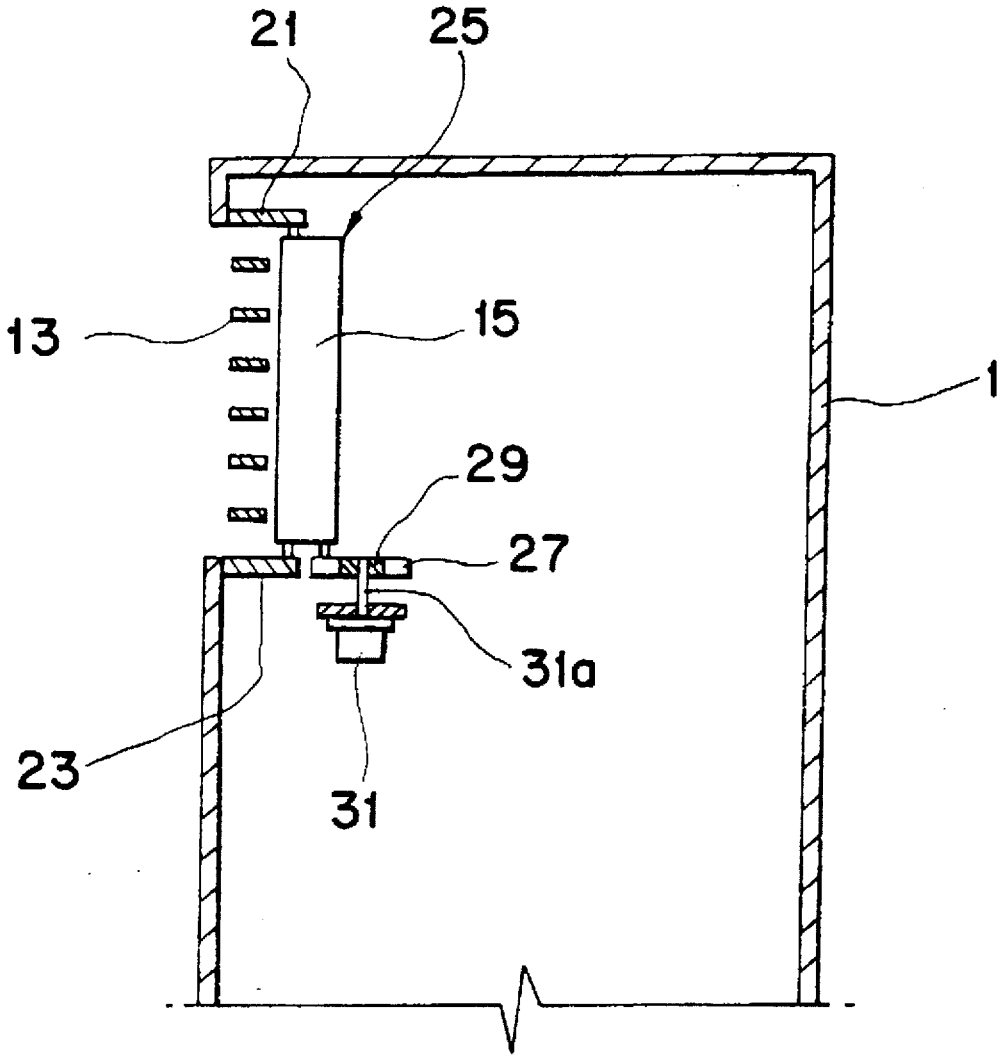
FIG. 2 (PRIOR ART)
FIG. 2 is a partial vertical sectional view of an air blowing direction adjusting apparatus for the conventional air conditioner.
Figure 3:
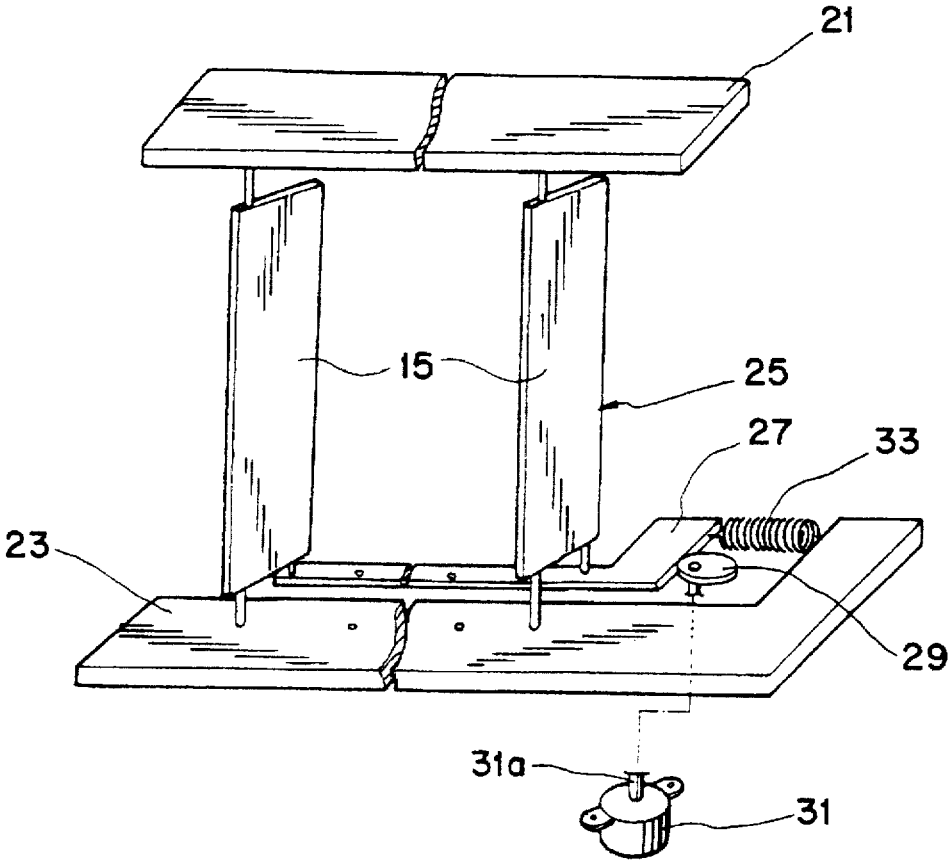
FIG. 3 (PRIOR ART)
FIG. 3 is a perspective view of the air blowing direction adjusting apparatus for the conventional air conditioner.
Figure 4A:
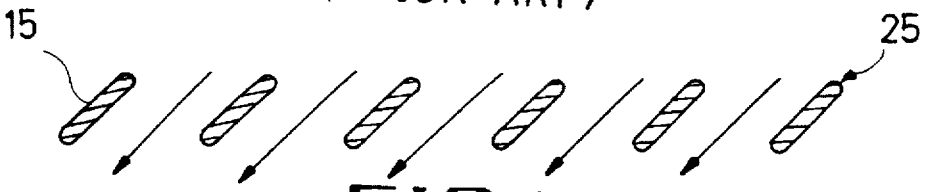
FIG. 4A (PRIOR ART)
FIGS. 4A to 4C are horizontal sectional views of the air blowing direction adjusting apparatus of the conventional air conditioner, wherein 3 specific blowing directions provided from the air blowing direction adjusting apparatus are shown, respectively.
Figure 4B:
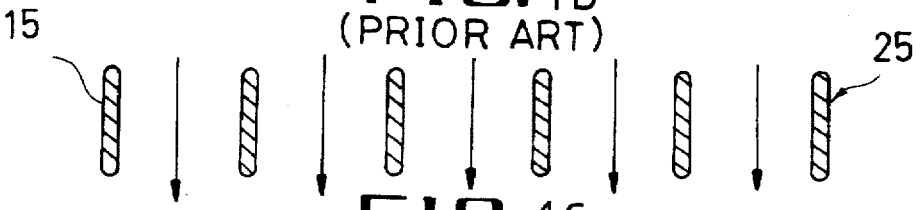
FIG. 4B (PRIOR ART)
Figure 4C:
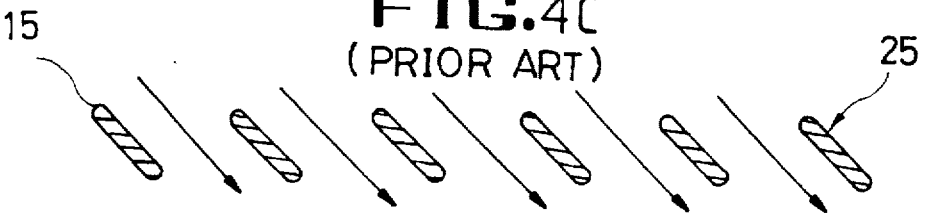
FIG. 4C (PRIOR ART)
Figure 5:
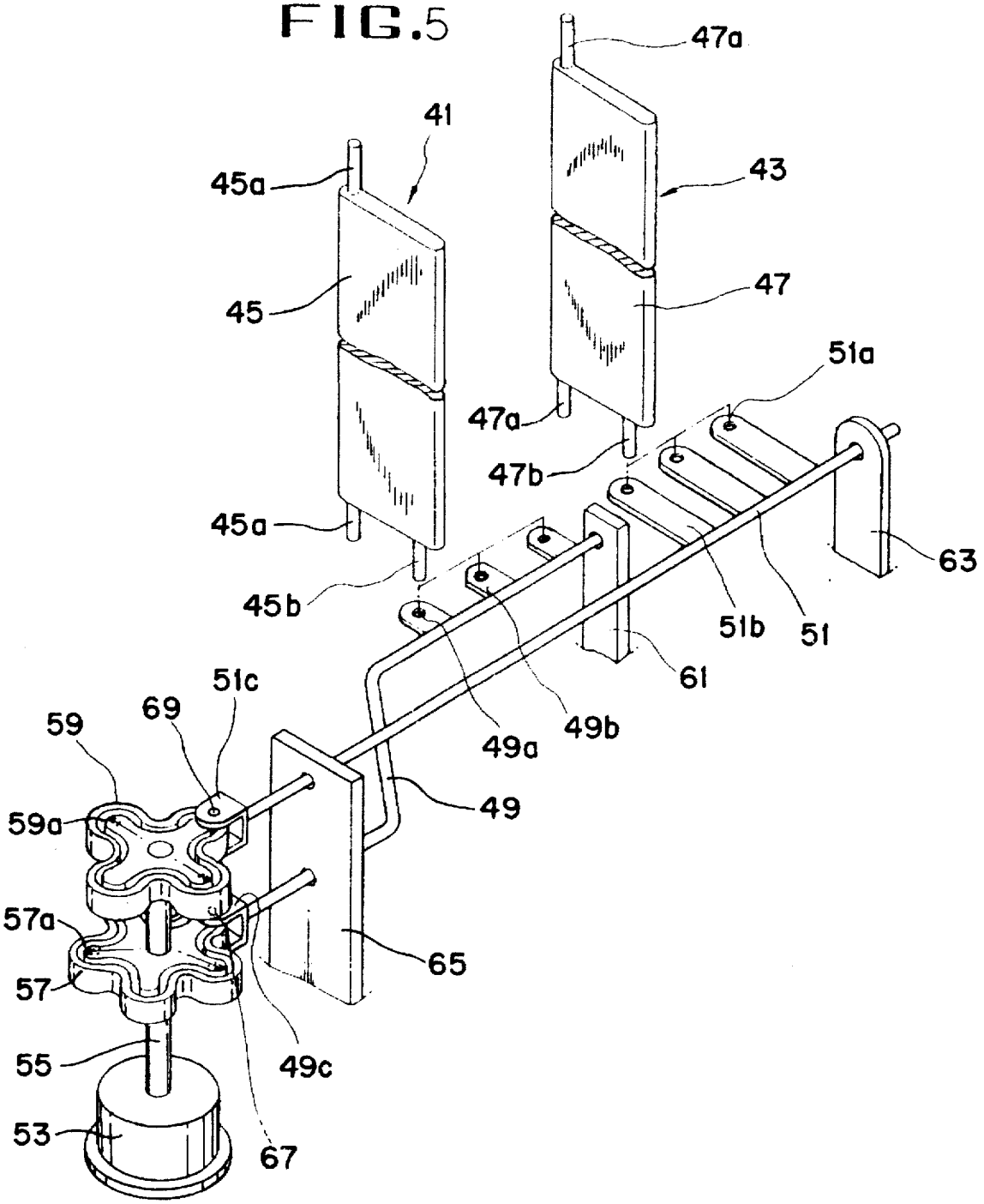
FIG. 5 is a perspective view of an air blowing direction adjusting apparatus of an air conditioner according to first embodiment of the present invention.

As shown in FIG. 5, the discharge outlet 9 of the air conditioner is provided with first and second groups of blades 41, 43, of which one group is arranged in a desired direction, not dependent upon the direction which the other group are taken, so as to give various directions of the air to be discharged.

The above-mentioned first and second groups of blades 41, 43 include a plurality of blades 45, 47, each of which is spaced a constant distance from each other, respectively.

Each blade in the first group of blades 41 has a lower portion thereof on which a first connecting rod 49 for the first group of blades 41 is positioned, and similarly each blade in the second blades 43 also has a lower portion thereof on which a second connecting rod 51 for the second blades 43 is positioned. And, each one of first and second connecting rods 49, 51 has left end portion coupled to each one of first and second recessed cams 57, 59 which arranged for allowing the respective rods 49, 51 to exhibit the rod linear motion, where cams are sequentially coupled to single driving shaft 55 of driving means 53.

The blades 45, 47 have top and bottom surfaces, respectively. Each of the top and bottoms surfaces has an elongated projection 45*a*(47*a*) adapted to be pivotally inserted into a supporting plate(not illustrated) which is installed in the discharge outlet 9. Further, the bottom surface has another elongated projection 45*b*(47*b*) located apart from the projection 45*a*(47*a*), through which the transmitted force from each first and second rods 49, 51 rotates the blades with the projection 45*a*(47*a*) placed in a rotational center.

The first and second connecting rods 49, 51 also have right end portion coupled to first and second guide posts 61, 63, respectively, which are arranged for supporting the respective rods 49, 51 and for guiding the connecting rods 49, 51 to perform their linear motions. And, each of first and second connecting rods 49, 51 is coupled to the respective recessed cams 57, 59 by way of through holes formed in a third guide post 65 located left for supporting the rods 49, 51 and for guiding the rods 49, 51 to perform their linear motions, where cams are sequentially coupled to single driving shaft 55 of the driving means 53.

Each of first and second connecting rods 49, 51 includes elongated parts outwardly extended from an outer surface thereof, each having a through hole 49*a*(51*a*) which is used in pivotally inserting the projection 45*b*(47*b*) of the blade 45(47), and has a socket element 49*c*(51*c*) formed at left end thereof to partially encompass a flange of the rod, wherein the socket element 49*c*(51*c*) has a guide pin 67(69) of a certain length inwardly provided therein.

Meanwhile, the first connecting rod 49 is bent to avoid the interference with the second connecting rod 51.

The first recessed cam 57 has at least 5 round teeth formed on an outer circumference thereof, and has recess 57*a* forming a continuous path of a closed loop like a ditch in each one of top and bottom surfaces thereof, such that the guide pin 56 can slide through the recess 57*a*.

The second recessed cam 59 has at least 4 round teeth formed on an outer circumference thereof, and has recess 59*a* forming a continuous path of a closed loop as in the first cam 57 in each one of top and bottom surfaces thereof, such that the guide pin 69 can slide through the recess 59*a*.

Each of first and second guide posts 61, 63 has a through hole for inserting the connecting rod 49 or 51, and the third guide post 65 has two through holes, similarly.

Next, the operation and effect in accordance with the first embodiment of the present invention as described above will be explained.

Upon the driving means 53 receiving the electric power to be rotated, the first and second recessed cams 57, 59 coupled to the driving shaft 55 of the driving means 53 are also rotated. Then, the rotation of the cams 57, 59 allows the respective guide pins 67, 69 to be able to travel along the ways or in the recesses 57*a*, 59*a* formed in the surface of the cams 57, 59, respectively. The respective linear motions of the first and second connecting rods 49, 51 can be thus effected, wherein the stable linear motions are guaranteed by the first to third guide posts 61, 63, 65.

Accordingly, the projections 45*b*, 47*b* inserted through the through holes 49*a*, 51*a* in the elongated parts 49*b*, 51*b* outwardly extended from the first and second connecting rods 49, 51 rotate the blades 45, 47 with the projection 45*a*, 47*a* placed in a rotational center, resulting in the pivotal movement of the blades 45, 47 by a certain angle.

When the blades 45, 47 are in the desired positions after they are moved as described above, the driving means 53 suspends its operation under the control of control mean(not shown).

Since the number of teeth of the first recessed cam 57 is different from that of the second recessed cam 59, the respective moving directions of the first and second blades 41, 45 are not identical to each other.

Figure 6A:
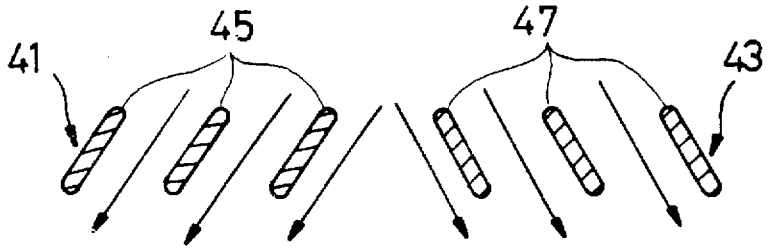
FIGS. 6A through 6E are horizontal sectional views of the air blowing direction adjusting apparatus according to first and second embodiments of the present invention, wherein various blowing directions provided from the air blowing direction adjusting apparatus are shown, respectively.
Figure 6B:
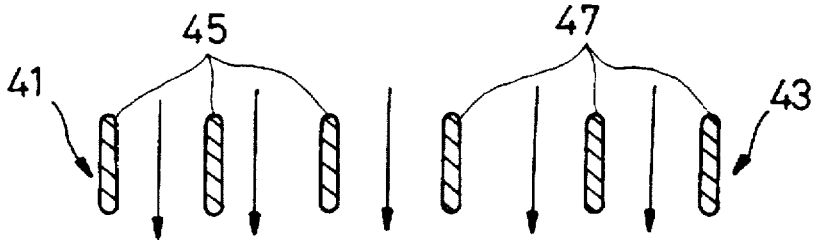
Figure 6C:
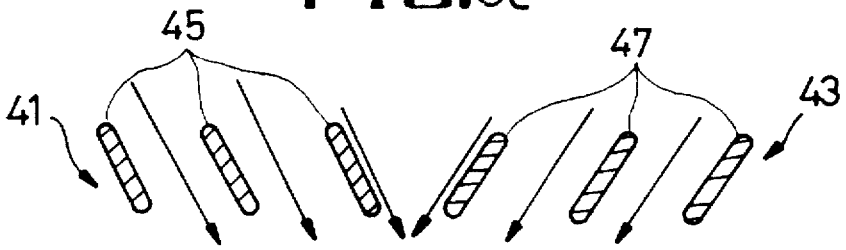
Figure 6D:
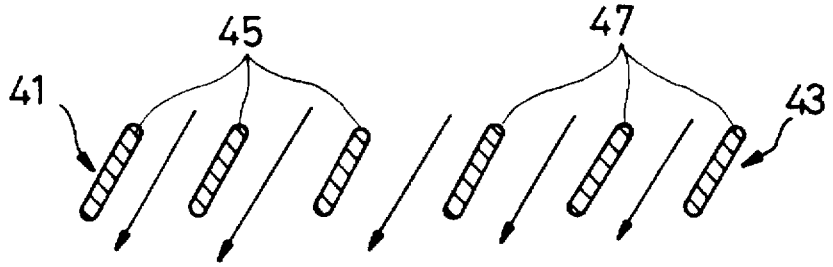
Figure 6E:
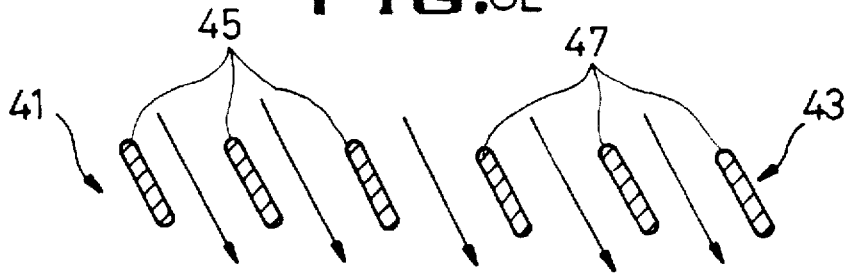

Therefore, as shown in FIGS. 6A to 6E, various directions for discharging the air can be taken by changing the positions of the respective first and second groups of blades 41 and 43 each including blades 45 and 47, and then the air can be blown through the discharge outlet with the blades after taking any desired direction among various directions. The state suitable for discharging the air toward both corners of the room is illustrated in FIG. 6A. FIG. 6B is suitable for uniformly discharging the air across the width of the discharge outlet; FIG. 6C is suitable for discharging the air into the central area of the room; FIG. 6D is suitable for uniformly discharging left the air in the room; and FIG. 6E is suitable for uniformly discharging right the air in the room.

The guide pins 67, 69 can be accurately traced along each one of recesses 57*a*, 59*a* of the first and second recessed cams 57, 59, which ensures to transmit the driving force and to accurately control phase.

Embodiment 2

Figure 7:
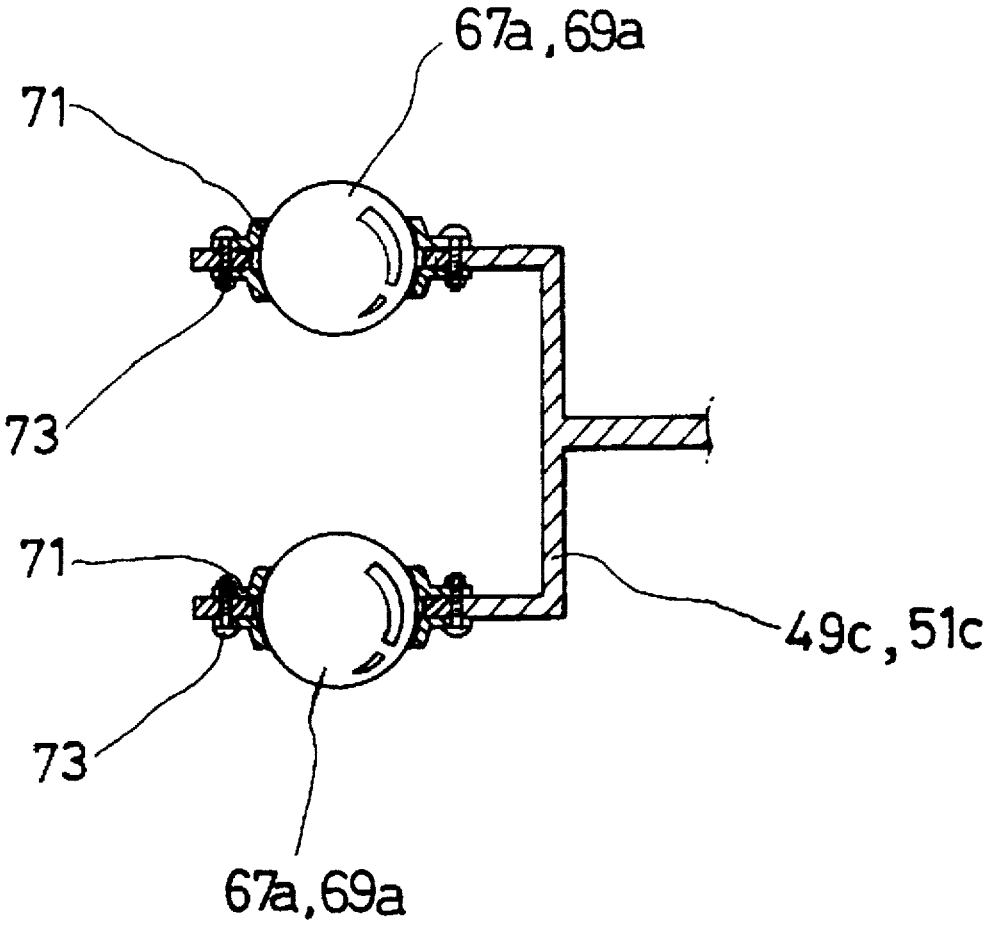
FIG. 7 is a vertical sectional view illustrating an installation of guide balls in accordance with second embodiment of the present invention.

The previous embodiment discloses an air blowing direction adjusting apparatus having preferred socket element 49*c*, 51*c* inwardly provided with guide pins 67, 69 of constant lengths therein, but not limited thereto, the present invention provides another preferred embodiment therefor, for example, as shown in FIG. 7. The drawing shows that the socket element in accordance with further embodiment has guide balls 67*a*, 69*a* provided such that they are free to be rotated. It should be apparent that further embodiment falls within the scope of the present invention.

The socket elements in accordance with the second embodiment are configured as a flange whose vertical section is like -shape. Such a configured flange is provided with a through hole(whose reference numeral not shown) for installing the guide balls 67*a*, 69*a*.

The guide balls 67*a*, 69*a* are inserted into the support bracket 71 which is in turn screwed to the socket elements 49*c*, 51 by using coupling means 73.

At this time, the guide balls 67*a*, 69*a* are installed apart from both an inner surface of the through hole and an inner surface of the support bracket 71 by a constant distance so as to be free to rotate, and the support bracket 71 closely contacts with both surfaces of the flange of each of socket elements 49*c*, 51*c*.

Embodiment 3

The foregoing disclosure and drawings are illustrative of the air blowing direction adjusting apparatus for manipulating the blades in right and left directions, but not limited thereto, the present invention is also applicable to an air blowing direction adjusting apparatus for vertically manipulating the blades, which also falls within the scope of the present invention.

Embodiment 4

Although the foregoing is concerned with an air blowing direction adjusting apparatus according to the present invention in which 2 recessed cams are employed for the control of two groups of blades, 3 cams or more can be utilized for the control of 3 or more groups of blades.

Embodiment 5

Without limiting the number of teeth of each cam as in the foregoing disclosure, various combinations of the number of the teeth can be employed for various applications.

As described above, an air blowing direction adjusting apparatus in accordance with 1st to 5th embodiments of the present invention advantageously provides various discharging directions of the air and a guaranteed transmission of driving force for an accurate phase control, with the structure of the guide pins installed into the recessed cams coupled to the driving shaft of the single driving means and of a plurality groups of blades, such that the blades in the group can change their displacements responsive to the action of the guide pins.

What is claimed is:

1. An air blowing direction adjusting apparatus for an air conditioner having a discharge outlet, and a plurality of blades installed in the discharge outlet for changing the discharging direction of the air, the apparatus comprising:

guide pins installed in a first cam and a second cam, respectively, wherein each cam receives driving force generated from single driving means to be driven; and first and second groups of blades divided into two groups for changing rotational positions of the blades independently for said each group or simultaneously for said two groups, in response to the actions of the guide pins.

2. The apparatus as defined in claim 1, wherein said first and second recessed cams comprises:

a circumferential surface having bend portions thereupon; and a continuous recess formed both upper and lower surfaces of each cam to form a closed loop, for sliding the guide pin through the recess.

3. The apparatus as defined in claim 2, wherein said circumferential surface comprises round teeth.

4. An air blowing direction adjusting apparatus for an air conditioner having a discharge outlet, and a plurality of blades installed in the discharge outlet for changing the discharging direction of the air, the apparatus comprising:

first and second cams installed to single driving means;

guide balls installed in each one of first and second cams; and first and second groups of blades divided into two groups for changing rotational positions of the blades independently for said each group or simultaneously for said two groups, in response to the actions of the guide pins.

5. The apparatus as defined in claim 4, wherein the guide balls are installed, by using supporting brackets, in socket elements formed at one end portion of a connecting rod provided for rotating the plurality of blades.

* * * * *